United States Patent [19]

Ogino

[11] 4,164,534

[45] Aug. 14, 1979

[54] METHOD OF PRODUCING LUMPS OF TANGLED FIBERS

[75] Inventor: Kiyoshi Ogino, Matsusaka, Japan

[73] Assignee: Central Glass Company, Limited, Ube, Japan

[21] Appl. No.: 886,111

[22] Filed: Mar. 13, 1978

[30] Foreign Application Priority Data

Mar. 14, 1977 [JP] Japan ..... 52/27073

[51] Int. Cl.[2] ..... B01J 2/16

[52] U.S. Cl. ..... 264/117; 264/115; 264/121; 264/122

[58] Field of Search ..... 264/117, 121, DIG. 51, 264/122, 115

[56] References Cited

U.S. PATENT DOCUMENTS

| | | | |
|---|---|---|---|
| 3,564,083 | 3/1969 | Fournet et al. | 264/117 |
| 3,632,257 | 1/1972 | Ashizawa | 264/117 |
| 3,904,726 | 9/1975 | Jacquelin et al. | 264/117 |

*Primary Examiner*—Robert F. White
*Assistant Examiner*—James R. Hall
*Attorney, Agent, or Firm*—Fleit & Jacobson

[57] ABSTRACT

Short filaments, or strands near filaments, of, for example, glass are introduced into a vessel such as a cyclone in which whirls around a gas such as air, resulting in entanglement of the filaments into ball-like lumps. Preferably the whirling of the gas and the introduction of the filaments into the vessel are made such that the fiber lumps are discharged downwards from the vessel while the gas is discharged upwards. The product is useful as a stuffing for heat- and/or sound insulation.

11 Claims, 1 Drawing Figure

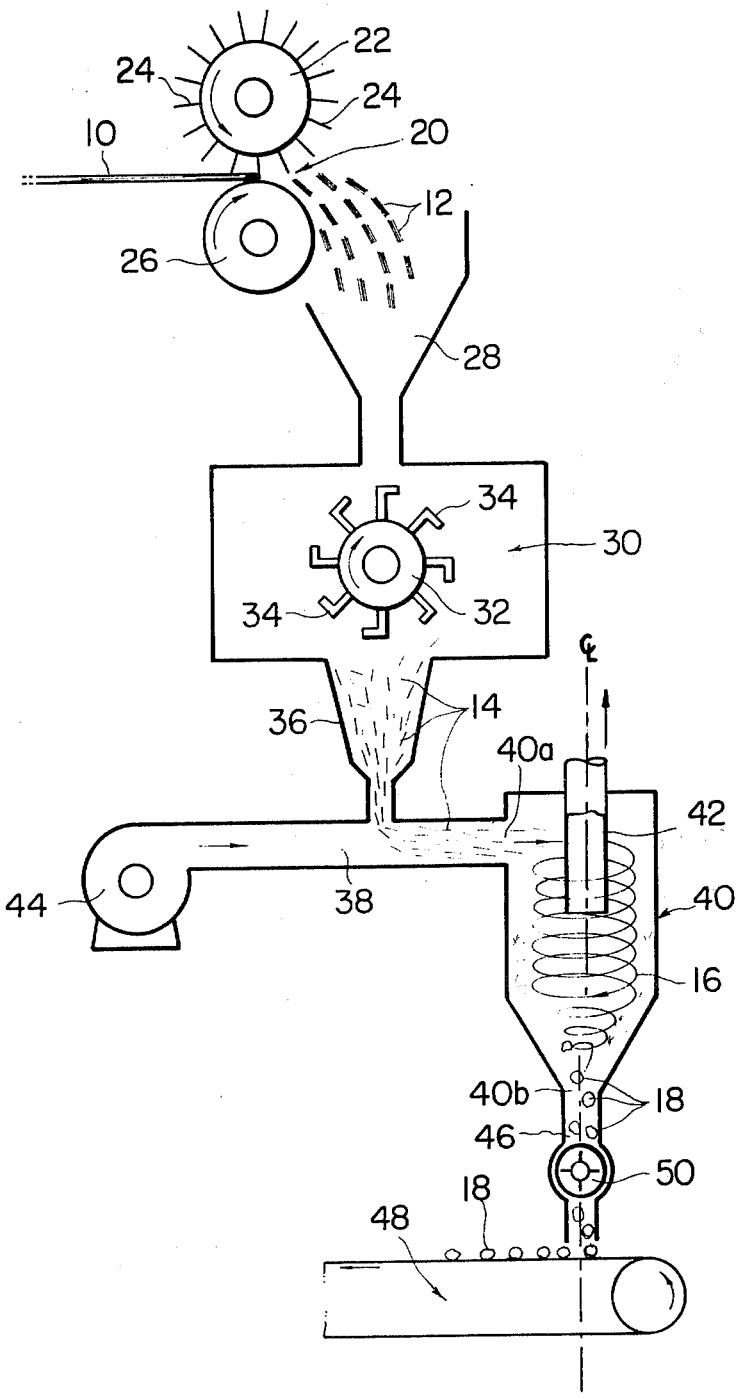
22
24
24
10
20
12
26
28
34
30
34
32
36
14
40a
42
44
38
40
16
40b
18
46
50
18
48

METHOD OF PRODUCING LUMPS OF TANGLED FIBERS

BACKGROUND OF THE INVENTION

This invention relates to a method of producing spherical or near spherical lumps of tangled fibers from short filaments.

Fibers of various kinds and particularly inorganic fibers typified by glass fiber are of use for heat- and/or sound insulation in a nonwoven form, and various methods are known for processing a fiber material into the form of felt. Meanwhile, there are many cases where convenience will be offered if a fiber material such as glass fiber is available in the form of a large number of balls or ball-like lumps of a suitable size. However, no method has yet been developed for industrial production of such fiber lumps.

SUMMARY OF THE INVENTION

It is an object of the present invention to provide a novel method of producing lumps of tangled fibers, which method can be readily put into industrial practice.

It is another object of the invention to provide a method of entangling short filaments of an inorganic fiber material such as glass into a number of ball-like lumps.

According to a method of the invention, a gas is made to continuously whirl round in a vessel, and short fibers substantially in an untwisted state are introduced into the vessel so as to be involved and dispersed in the gas whirl. Then the short fibers individually tangle with each other to form lumps.

Air is convenient as the whirling gas, and a cyclone is suitable as the vessel. It is preferable that the whirl of the gas in the vessel and the introduction of the short fibers into the vessel are made such that the fiber lumps fall towards the bottom of the vessel while the gas is discharged upwards from the vessel.

The method of the invention is applicable to either an organic fiber or an inorganic fiber, and it is possible to use two or more kinds of fibers together.

The fiber lumps produced by the method of the invention are of use particularly as a stuffing or padding material for heat- and/or sound insulation.

BRIEF DESCRIPTION OF THE DRAWING

The single FIGURE shows schematically and sectionally an example of apparatus for performing a method according to the invention.

DESCRIPTION OF PREFERRED EMBODIMENTS

In the drawing indicated at 10 is roving or a bundle of continuous glass fibers, which are preferably untwisted but parallelized. The fiber bundle 10 is fed to a chopping machine 20 which has a cutting roll 22 provided with a plurality of cutter blades 24 on its cylindrical surface with uniform circumferential intervals and a reversely rolling backup roll 26 having a smooth cylindrical surface to serve as an anvil for the cutter blades 24. The fiber bundle 10 passes between these two rolls 22, 26 to be chopped by the cutter blades 24 into a uniformly short length. The resultant bundles of short fibers, which may be called chopped strands 12, fall into a hopper 28. The chopped strands 12 are fed from the hopper 28 into an untangling machine 30 having a rotary drum 32, which is provided with hook-shaped blades 34 on its cylindrical surface and installed in a chamber located beneath the hopper 28. The chopped strands 12, therefore, fall on the drum 32 and collide against the blades 34 of the rotating drum 32. Naturally the chopped strands 12 are beaten and flipped by the blades 34 and forced to make complicated movement around the drum 32. As a consequence the chopped strands 12 are almost completely untangled into short filaments as indicated at 14.

There is a cyclone 40, which is analoguous to a primitive cyclone separator, as the most important component of the illustrated apparatus. This cyclone 40 has the shape of an upright cylinder in its major portion with an inlet **40*a* in the side wall, and its lower-most portion has the shape of a cone truncated at the bottom of the cylinder 40 to form an outlet 40*b*. A pipe 42 is arranged coaxially in the cyclone 40 so as to protrude upwardly through the ceiling of the cyclone 40. The end of the pipe 42 in the cyclone 40 is positioned at a level somewhat below the level of the inlet 40*a*. A duct 38 connects a blower 44 to the inlet 40*a* such that air supplied from the blower 44 is introduced into the cyclone 40 generally tangentially. This duct 38 extends below the untangling machine 30, and a hopper 36 is arranged so as to introduce the fiber filaments 14 into the duct 38 at a section somewhat upstream of the cyclone 40**.

A high velocity air stream through the duct 38, carrying the fiber filaments 14, enters the cyclone 40 tangentially with the result that a dispersion of the filaments 14 in air whirls around within the cyclone 40 as indicated at 16. While the whirl 16 proceeds downwards, the filaments are well scattered and individually tangle with each other, and as a consequence gradually turn into a large number of ball-like fiber lumps 18. These lumps 18 become less buoyant as they grow individually and finally get out of the whirling air to fall towards the outlet **40*b* of the cyclone 40. On the other hand, the whirling air is gradually discharged upwards from the cyclone 40 through the pipe 42**.

A duct 46 is arranged so as to guide the fiber lumps 18 to a belt conveyer 48, with the provision of an air lock 50 of a rotary type to prevent downward outflow of air from the cyclone 40 through the outlet **40*b***.

The glass fiber 10 in the above description is merely by way of example, though the lumps 18 of glass fiber will be widely used. The method of the invention is applicable to almost every kind of fibers. Examples of particularly suitable fibers are inorganic fibers such as of glass, asbestos, carbon, boron and some kinds of metals and organic fibers such as of polyvinyls, acryls, polypropylene, and celluloses. As will be apparent from the above description, it is possible and quite easy to use two or more kinds of fibers together, including a combination of organic and inorganic fibers.

It will be understood that the filaments 14 are not necessarily prepared through the illustrated chopping and untangling procedures but may be prepared by any other method. Even when chopping and untangling procedures generally as illustrated are employed, the fiber may not be initially roved or parallelized, and the chopped strands 12 may be irregular in length. Furthermore, it is not a requisite that the fiber is introduced into the cyclone 40 literally as a dispersion of independent filaments in air stream. It is within the scope of this invention that each of the filaments 14 in the drawing is actually a tangled or twisted gathering of several filaments. Gathering of a large number of filaments is undesirable because it will result in an unsufficient tangling of the filaments in the individual fiber lumps 18.

The cyclone 40 may be constructed differently from the illustration. For example, the filaments to be lumped may be introduced into a cyclone separately from the air stream.

The shape and size of the individual fiber lumps 18 can be varied by varying the design and/or operating condition of the cyclone in dependence on the size and physical properties of the filaments.

EXAMPLE

About 3 mm long and about 9–13 mμ thick glass filaments 14 were treated in the cyclone 40 of the illustrated type. The cylindrical portion of the interior of the cyclone 40 was about 520 mm in diameter and about 1600 mm in height, and the inlet 40*a* was located about 1200 mm below the ceiling. The conical portion of the interior of the cyclone 40 was about 330 mm in height and about 300 mm in diameter at the truncated bottom, i.e. the outlet 40*b*. The air discharge pipe 42 had an outer diameter of about 255 mm. The flow of air through the duct 38 had a volume flow rate of 23 $m^3$/min and a wind pressure of 190 mmAq. The velocity of the air at the inlet 40*a* to the cyclone 40 was 14 m/sec. Under this condition, the glass filaments supplied to the cyclone 40 turned into ball-like fiber lumps 18 of individually about 2 to 15 mm in diameter. These lumps 18 had a resemblance in structure and feeling to cotton balls rounded by hand.

A method of the invention has the following advantages.

(1) The method can be practiced by means of an apparatus simple both in construction and in operation.

(2) It is possible to utilize very short fibers which are unsuitable for textiles or as reinforcing materials for plastic materials.

(3) The size and density of the fiber lumps can be varied over wide ranges by varying the operating condition of the lumping apparatus such as a cyclone in dependence on the physical properties of the filaments.

(4) The fiber lumps can be obtained with a nearly uniform size by maintaining the operating condition of the lumping apparatus such as a cyclone constant.

What is claimed is:

1. A method of producing lumps of tangled fibers, comprising the steps of:

continuously whirling a gas around in a vessel; and introducing short fibers which are substantially in an untwisted state into said vessel so as to be involved and dispersed in the whirling gas, whereby said short fibers, absent an added binder, are subjected to sufficient individual tangling with each other to form individual fiber lumps which fall towards the bottom of said vessel.

2. A method as claimed in claim 1, wherein the whirling gas is discharge upwardly from said vessel.

3. A method as claimed in claim 2, wherein said vessel has the construction of a cyclone arranged such that said gas whirls around a vertical axis of a generally cylindrical chamber in the cyclone.

4. A method as claimed in claim 2, wherein both said gas and said short fibers are introduced into said vessel through a single inlet.

5. A method as claimed in claim 2, wherein said short fibers are introduced into said vessel separately from said gas.

6. A method as claimed in claim 1, wherein said short fibers are converted substantially to filaments before the introduction thereof into said vessel.

7. A method as claimed in claim 1, wherein said gas is air.

8. A method as claimed in claim 1, wherein said short fibers are a mixture of at least two kinds of fibers.

9. A method as claimed in claim 1, wherein said short fibers are of an inorganic fiber material.

10. A method as claimed in claim 9, wherein said inorganic fiber material is glass fiber.

11. A method of producing lumps of tangled fibers, comprising the steps of:

introducing short fibers which are substantially in an untwisted state into a stream of a gas to produce a dispersion of said short fibers in said gas; and whirling said dispersion around in a vessel, whereby said short fibers, absent an added binder, are subjected to sufficient individual tangling with each other to form individual fiber lumps which fall towards the bottom of said vessel.

* * * * *